United States Patent [19]

Paradise

[11] Patent Number: 4,635,655

[45] Date of Patent: Jan. 13, 1987

[54] HAIR-WAVING ROD

[76] Inventor: Norman P. Paradise, 14554 Big Basin Way, Saratoga, Calif. 95070

[21] Appl. No.: 604,691

[22] PCT Filed: Apr. 19, 1983

[86] PCT No.: PCT/US83/00608

§ 371 Date: Apr. 16, 1984

§ 102(e) Date: Apr. 16, 1984

[87] PCT Pub. No.: WO83/03529

PCT Pub. Date: Oct. 27, 1983

Related U.S. Application Data

[63] Continuation-in-part of Ser. No. 369,436, Apr. 19, 1982, Pat. No. 4,403,621.

[51] Int. Cl.[4] ..... A45D 2/00

[52] U.S. Cl. ..... 132/40; 132/38 R

[58] Field of Search ..... 132/7, 9, 38 R, 45 R, 132/79 A, 88.7, DIG. 3, 39, 40, 41, 42 R

[56] References Cited

U.S. PATENT DOCUMENTS 3,618,620 11/1971 Williams ..... 132/9
3,662,767 5/1972 Murtha ..... 132/9
3,688,778 9/1972 Budman et al. ..... 132/9
3,923,068 12/1975 Gilman ..... 132/9
4,349,038 9/1982 Morefield ..... 132/40

*Primary Examiner*—Gregory E. McNeill
*Attorney, Agent, or Firm*—Townsend and Townsend

[57] ABSTRACT

A hair-waving implement especially suited for giving a gentle body wave to long hair comprises first means defining an elongate rod member, second means defining a plurality of slender axially extending passageways within the rod member, and third means defining a diverting chamber at an end of the rod member in flow communication with the passageways. The elongate rod member is of generally cylindrical shape for receiving coils of hair. The slender passageways are angularly spaced about the periphery of the rod member and are in flow communication along their length with the exterior of the rod member. The diverting chamber has an inlet for receiving hair treatment solution and is structured so that a quantity of solution forcefully squirted into the chamber will be directed in roughly equal flow to all of the axial passageways and forced to the exterior of the rod member so as to penetrate from the inside out the coils of hair wrapped around the rod member.

3 Claims, 6 Drawing Figures

HAIR-WAVING ROD

CROSS-REFERENCE TO RELATED APPLICATION

This is a continuation-in-part of application Ser. No. 369,436, filed Apr. 19, 1982, now U.S. Pat. No. 4,403,621.

BACKGROUND OF THE INVENTION

The invention relates to rods or rollers of the type used by hair stylists and beauticians to give a permanent curl or wave to naturally straight hair.

The commonly practiced method of imparting a lasting curl or wave to hair comprises three basic steps. First, strands of hair are wrapped around rods or rollers and clamped in the wrapped configuration. Then, a chemical agent is applied to the wrapped hair, which causes the hair to undergo a chemical change, enabling the inner structure of each strand of hair to conform Citself more or less to the curvature of the rod around which it is wrapped. Finally, a fixative step is carried out to stop the action of the chemical agent. The fixative step typically involves the application of a second chemical agent, or heat, or both. These steps are frequently supplemented with a shampoo or other premoistening step and conditioning steps for damaged, unhealthy or over-porous hair.

Several difficulties are routinely encountered in carrying out the above process. There is a natural tendency to wrap the hair too tightly on the rods. Tight wrapping prevents the chemical waving lotion from uniformly and thoroughly penetrating the strands of hair, and it interferes with the natural expansion of the hair under the action of the waving lotion. The result is irregular, imperfect and short-lasting curls. Moreover, tight wrapping can lead to hair breakage and causes neighboring strands of hair to rub against one another in a "sandpaper" effect, giving the hair a frizzy appearance.

Other difficulties routinely encountered in the application of the chemical waving agent relate to the possibility of injury to the patron. Some commonly used waving solutions are highly alkaline, having a pH on the order of 9. Any prolonged contact of such waving solution with the patron's scalp, even in small amounts, is to be avoided. In fact, in order to be certified by appropriate regulating bodies, cosmetologists are frequently called upon to demonstrate a proficiency at applying the proper amount of waving solution to wrapped rollers without allowing any to contact the patron's scalp. Other compounds are available which have a lower pH, but even these can cause irritation in a healthy scalp and will certainly cause irritation where lesions of the scalp are present. Cosmetologists who work with the waving solution repeatedly throughout the day typically wear rubber gloves or protective cream to guard against such irritation.

Long hair exacerbates the above difficulties to such an extent that a patron with naturally straight long hair simply cannot obtain a permanent giving a satisfactory gentle body wave to the hair. Long-haired patrons in the past have resigned themselves to permanents with tight curls and a frizzy appearance, while often having to suffer the irritations of the chemical waving lotion on the scalp.

The problem of giving a gentle body wave to long hair lies in the rollers. A body wave, in distinction to a curl, requires a large diameter roller. Known rollers are subject to any of the following deficiencies when used with long hair; they do not facilitate full or uniform saturation of the hair; they require an excessive amount of lotion to achieve saturation with the result that the lotion invariably comes in contact with the scalp or skin of the neck or face; long hair tends to wrap too tightly around them with resultant frizziness; they have undesirable mechanical limitations; for example, some rollers are not reusable, and others employ intricate and expensive constructions to provide means for applying the chemical agent under pressure and the like. All of the known rollers represent a tradeoff between these deficiencies, and the tradeoff becomes greater as the diameter of the rod is increased.

SUMMARY OF THE INVENTION

The invention provides an improved hair-waving implement which is especially suited for giving a body-wave permanent to long hair. Briefly, the implement comprises a first means defining a generally cylindrical elongate rod member, around which strands of hair are wrapped. A plurality of axially extending passageways are angularly spaced within the rod member about its periphery. Each passageway is in flow communication along its length with the exterior of the rod member. A diverting chamber is located at an end of the rod member and is in flow communication with the plurality of passageways. The chamber has an inlet for receiving hair treatment solution and is structured to divert the solution introduced through the inlet to each of the passageways in roughly equal flow, the solution flowing along the passageways and to the exterior of the rod member to the wrapped strands of hair.

In the construction of the present invention hair coiled around the rod member is moistened with the waving lotion from the inner coils to the outer ones. To assist in forcing the hair treatment solution through the coils of wrapped hair, the diverting chamber is structured so that the aggregate cross-sectional area of all the openings communicating fluid flow between the chamber and the passageways is comparable with the cross-sectional area of the inlet itself. Solution will be applied to the hair most easily and evenly if the indicated aggregate cross-sectional area is no more than about twice the inlet cross-sectional area. Moreover, to prevent excess solution from dripping through the rod member after the hair is saturated, it is preferable that the diverting chamber have a small volume relative to the volume of hair treatment solution typically to be applied to the hair coiled about the rod member.

An embodiment of the invention particularly amenable to molded plastic fabrication comprises a three-piece construction. A first piece provides a hollow outer cylinder having a plurality of axial grooves spaced about its circumference. An inner cylinder is adapted to be inserted within the outer cylinder. The inner cylinder is closed at one end and has an annular flange at the opposite end. The portions of the outer cylinder which extend between adjacent grooves are formed along their inner surface so as to contact the inserted inner cylinder along its length, thereby defining a plurality of axial passageways, and the flange at the end of the inner cylinder is formed to block the passageways at one end. The outer cylinder is provided with a wall at one end having a centrally located inlet aperture. This wall and the closed end of the inner cylinder define a chamber communicating with the axial passageways. Furthermore, baffles are provided within the chamber to direct flow of hair treatment solution introduced at the inlet aperture to the passageways. The third piece of the construction is a cap, which is formed to secure the inner cylinder within the outer cylinder and to secure the flange in its passageway-blocking configuration.

For a further understanding and appreciation of the nature and advantages of the invention, reference should be made to the remaining portion of the specification and to the attached drawings.

DETAILED DESCRIPTION OF THE PREFERRED EMBODIMENTS

Figure 1A:
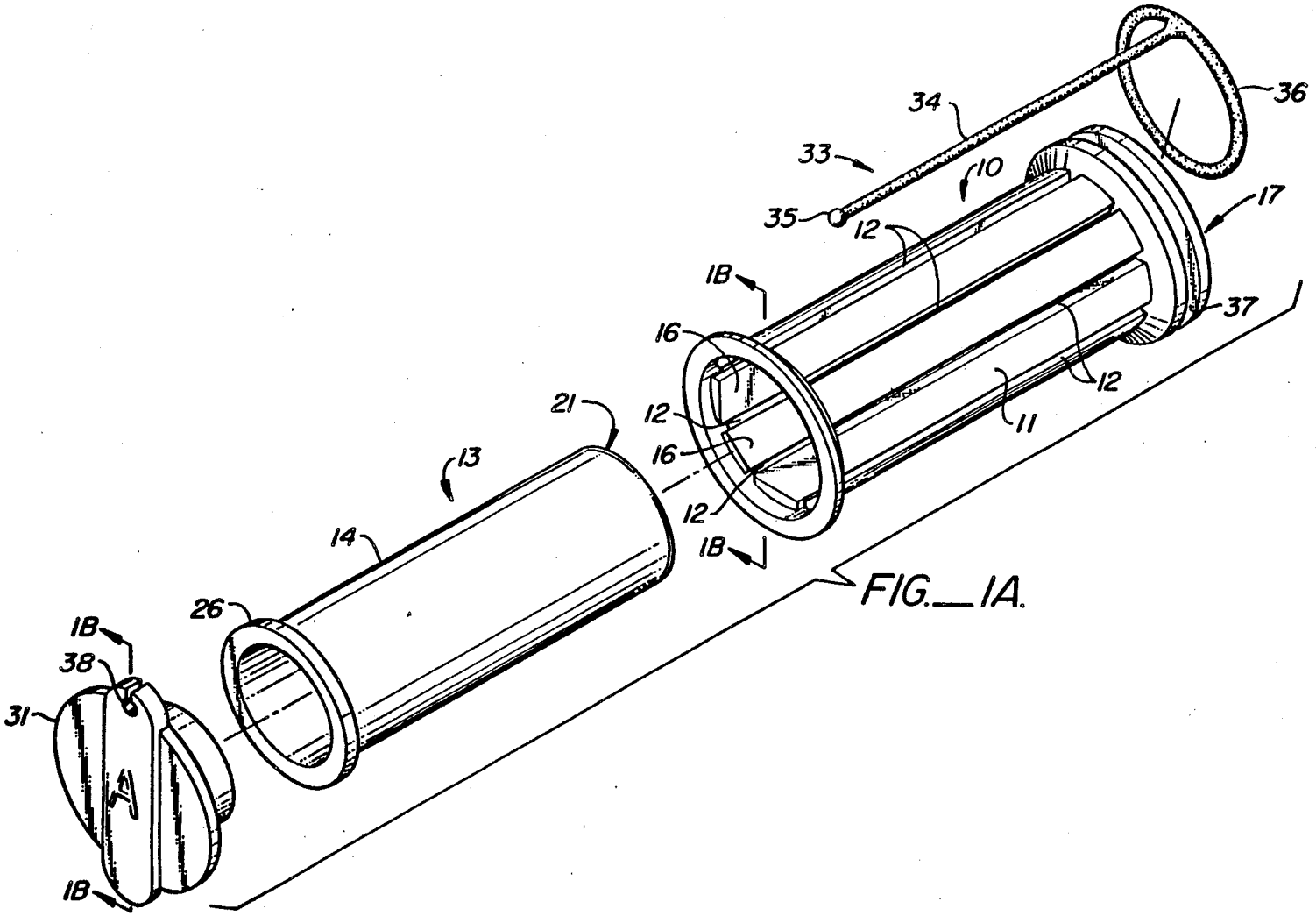
FIG. 1A is an exploded isometric view of a hair-waving implement constructed in accordance with the invention.

An overall view of a preferred embodiment of a hair-waving implement constructed in accordance with the invention is shown in FIG. 1A. A first member 10 defines an elongate rod member having an outer wall 11 of generally cylindrical shape. Wall 11 provides a surface around which strands of hair are coiled in the process of giving a permanent body wave to the hair as explained more fully hereinbelow. Member 10 is provided with a plurality of axial grooves 12, which are angularly spaced about the cylindrical wall 11. A second member 13 defines an inner cylindrical wall 14, which is dimensioned to fit within the first member 10. The member 10 is provided with partitioning means 16 between the inner and outer cylindrical walls 14 and 11. The partitioning means 16 abuts against cylindrical wall 14 to define a plurality of slender axial passageways 15, which are uniformly angularly spaced about the region between walls 11 and 14 with each passageway communicating with the exterior of member 10 through one of the plurality of grooves 12.

In the embodiment of FIG. 1A the partitioning means 16 is provided by a plurality of flat sections formed on the inner surface of outer cylindrical wall 11. Each such flat section extends between two adjacent axial grooves 12. That is to say, each flat section 16 lies along a chord of the circular circumference of cylindrical wall 11 and stretches from one axial groove to the next. The flat sections 16 and inner cylindrical wall 14 are cooperatively dimensioned to engage one another along axially extending lines of contact so as to define the walls separating one axial passageway from the next.

Figure 2:
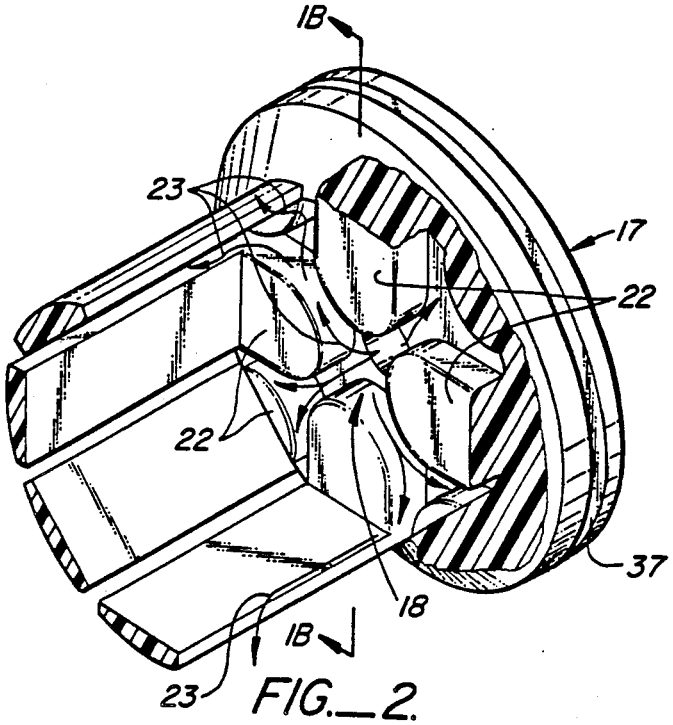
FIG. 2 is a partially cut-away view of the outer cylinder showing the means defining the diverting chamber and baffles.

Member 10 defining rod member outer wall 11 also carries means 17 defining a closed end of the member 10 and further serving to define a fluid-diverting chamber in flow communication with all of the axial passageways 15. FIG. 2 shows a partially cut-away view of end-defining means 17, in which the diverting chamber 18 is visible. The end means 17 is provided with a centrally located inlet aperture 19. Member 13 defining inner cylindrical wall 14 is provided with a closed end 21, which cooperates with the means 17 closing off the end of member 10, so as to completely define the diverting chamber 18. Means providing baffles 22 are positioned within the region between the means 17 and closed end 21. In the process of giving a perm, hair treatment solution is introduced into inlet aperture 19 and is directed by baffles 22 along the course indicated by arrows 23 to each of the slender axial passageways 15. The hair-waving implement preferably has at least four such axial passageways and four corresponding grooves so as to cause hair treatment solution to be applied directly to the hair at several positions around the circumference of the rod. This is in distinction to other rollers in which the solution is applied to the hair at only one or two locations and is expected to flow around the roller to moisten the wrapped hair.

Figure 1B:
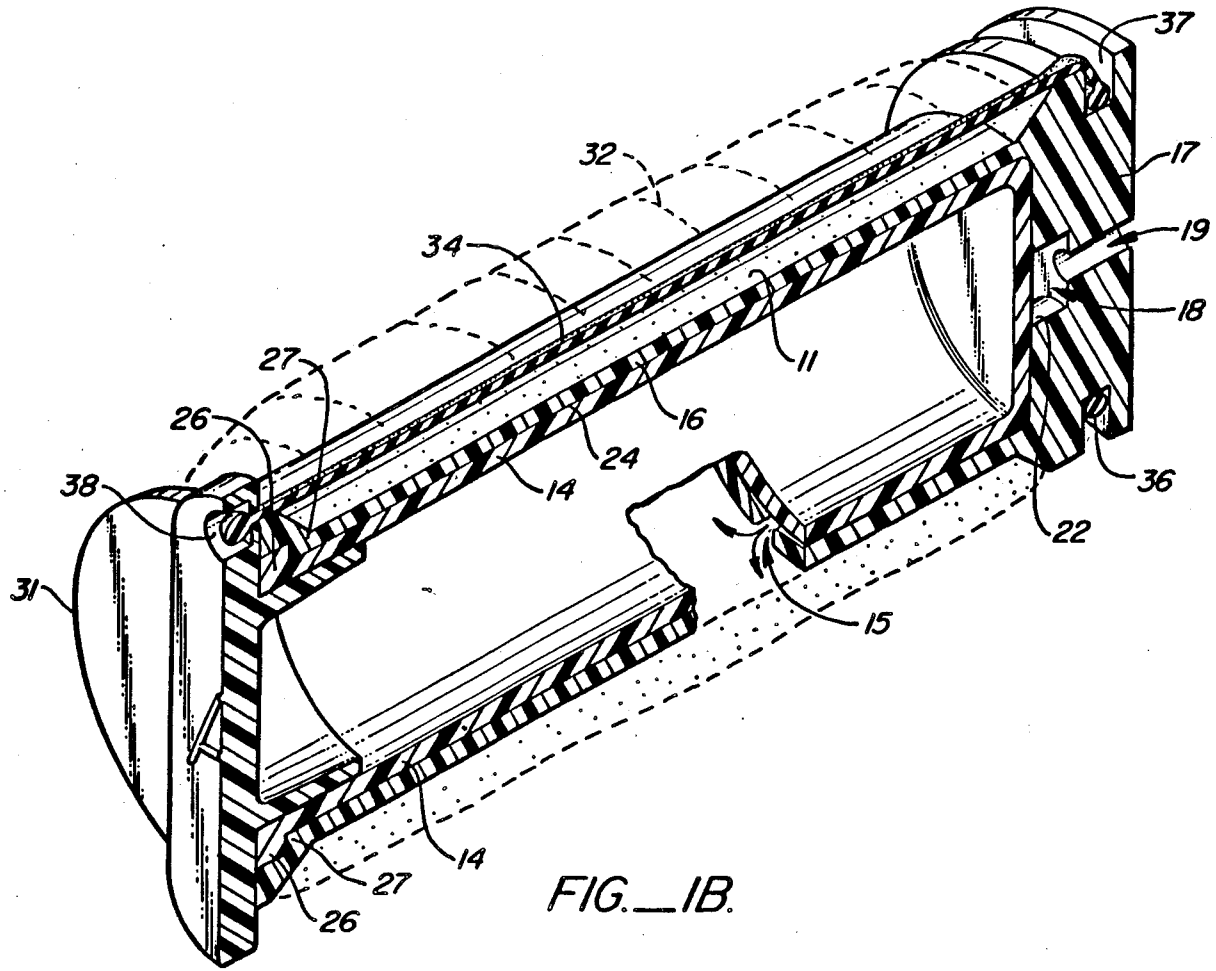
FIG. 1B is a cross-sectional view of an assembled hair-waving implement taken along the line 1B—1B.

The assembled hair-waving implement is shown in cross section in FIG. 1B. The cross section is taken along the line 1B—1B indicated in FIGS. 1A and 2. Inlet aperture 19 and a portion of diverting chamber 18 are visible in FIG. 1B. A line of axial contact 24 between inner cylindrical wall 14 and partitioning means 16 is also visible in this figure, which has been partially cut away to reveal a portion of an axial passageway 15.

Member 13 is provided with a flange 26, which is formed to abut against the end 27 of partitioning means 16. In this abutting relation flange 26 serves to close off the ends of the axial passageways.

In the illustrated embodiment the hair-waving implement is provided with a cap 31, which serves to secure member 13 within member 10 and to hold flange 26 in its passageway-blocking configuration.

In the process of giving a permanent, the hair-waving implement is assembled as in FIG. 1B, and strands of hair 32 are coiled around outer cylindrical surface 11, as indicated in phantom in FIG. 1B. It is the common practice in using hair rollers to retain the hair in its wrapped configuration by means of a rubber band or similar such clamping means, which hooks on either end of the roller and exerts a downward pressure on the hair. Such clamping means is known to leave a slight, but noticeable demarcation line in the hair after it is unwrapped. To prevent the formation of such a demarcation line, the present hair-waving implement is provided with means 33 for retaining the hair in its wrapped configuration. The means 33 is formed of an elastomeric material and has a shank portion 34, a check or catch means 35 at one end, and a ring member 36 at the other end. The hair-waving implement is provided with attachment means at its ends for securing the means 33. As seen in FIG. 1A, member 10 is provided with an annular groove 37 at one end, and cap 31 is provided with an eyehole groove 38 for receiving and retaining check member 35. As illustrated in FIG. 1B, when means 33 is in position on the hair-waving implement, it is held in offset relation from the surface 11 about which the hair is coiled. In this manner the means 33 will exert enough pressure against the coiled hair to retain it in its wrapped configuration, but not enough pressure to produce a demarcation line.

In operation, the hair-waving implement is assembled as in FIG. 1B, and a length of hair is coiled around the cylindrical surface 11 in the manner well known to one trained in the cosmetological art and retained by means 33. Hair waving lotion is then introduced into diverting chamber 18 typically by means of a squeeze bottle inserted into inlet 19. The hair waving lotion will pass through diverting chamber 18, where it is directed to each of the axial passageways, 15, and then pass through axial grooves 12 to come in contact with the inner coils of hair wrapped around rod member 11.

The manner in which the hair waving lotion is directed to the coils of hair is an important aspect is the invention. In the conventional method the hair waving lotion is applied to the outer surface of the coiled hair along the top, and to the extent possible, along the bottom of the wrapped roller. With this larger diameter rollers needed to give a body wave to long hair, the hair waving lotion cannot be applied to saturate the hair uniformly without using so much waving lotion that contact with the patron's scalp is bound to occur. The present design causes the lotion to be applied to the coils of hair from the inside out. With small or medium sized roller this goes a long way to prevent contact of the hair waving lotion with the patron's scalp. For the larger rollers needed to give a body wave to longer hair, the expedient of applying the waving lotion from the inside out is by itself insufficient to prevent contact of the lotion with the scalp. What may work for smaller rollers fails to work for larger rollers because of the greater influence of gravity. With a larger roller more of the lotion must be caused to flow "uphill" to saturate the hair on the top portion of the roller. If the lotion is merely applied to the hair from the inside out, saturation of the hair at the top of the roller will normally be accompanied by oversaturation of the hair at the bottom of the roller with the resultant excess lotion available to drip onto the scalp or skin of the neck.

This problem is overcome in the present invention by the particular structure of diverting chamber 18 and the manner in which it communicates with the axial passageways 15 along the length of the rod member 11. With the present construction waving lotion squeezed through inlet 19 will be forced under pressure along the axial passageways and through the grooves 12 to penetrate the coils of hair wrapped therearound. It is primarily the squeeze of the squeeze bottle, and not the influence of gravity, which moves the lotion to and through the hair. To achieve this effect, it is necessary that the aggregate cross-sectional area of all of the openings which communicate fluid flow between diverting chamber 18 and axial passageways 15 be roughly comparable with the cross-sectional area of inlet aperture 19. In this manner, the waving lotion will be squirted into the passageways with roughly the same force as it is squirted into the aperture 19. Thus, a firm squeeze of the squeeze bottle will override the influence of gravity to a great extent and cause the lotion to penetrate the strands of hair uniformly at several positions around the roller. The force with which the lotion is squirted into the passageways and through the grooves 12 will, of course, decrease as the above-indicated aggregate cross-sectional area is increased. One skilled in the art will readily be able to determine the limits on the aggregate cross-sectional area which will yield adequate flow of the lotion. As a general rule, however, it is recommended that the aggregate cross-sectional area be no more than about twice the cross- sectional area of aperture 19. For especially large rollers it may be necessary to supplement the waving lotion injected into and through the roller by applying a small amount of lotion to the exposed coils of hair at the top of the roller.

After the hair has been properly saturated with hair treatment solution, any excess solution in diverting chamber 18 will ultimately pass under the influence of gravity through grooves 12 and yield an excess of solution along the portion of the roller. To minimize this excess, diverting chamber 18 should have a volume which is small relative to the total volume of hair waving solution to be applied to the hair wrapped around any one roller. This volume, of course, depends upon the size of the roller used and is readily ascertainable by one skilled in the art.

Figure 4:
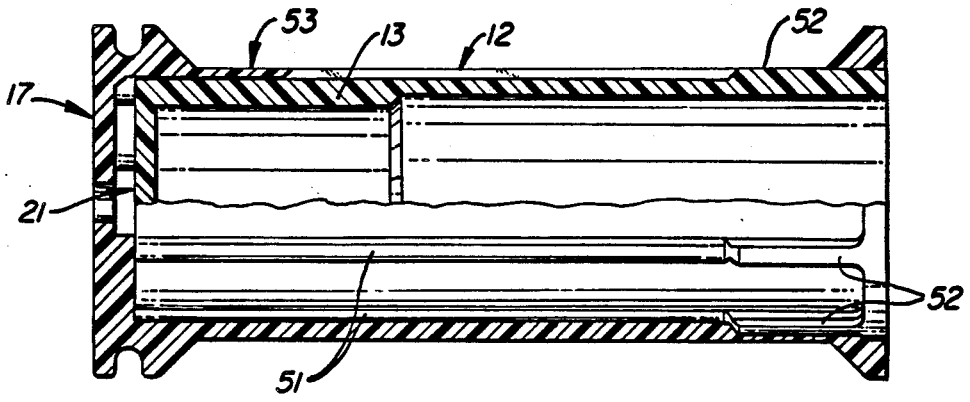
FIG. 4 is a longitudinal cross-sectional view of another embodiment of the invention with a portion of the inner cylindrical member shown in elevation.
Figure 5:
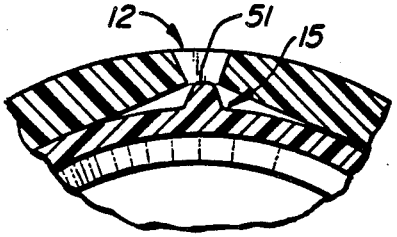
FIG. 5 is a transverse cross-sectional view showing a detail of the embodiment of FIG. 4.

A problem can sometimes arise in the application of the present hair-waving rod when a watery hair treatment solution is used, that is, a hair treatment solution having a low viscosity. Watery solutions tend to be absorbed quicker by the hair. Consequently, watery solutions tend to saturate that strands of hair closest to diverting chamber 18 before the strands of hair at the other end of the rod are saturated. Another embodiment of the invention circumventing this problem is illustrated in FIGS. 4 and 5. As can be seen in the cross-sectional view of FIG. 5, the inner cylinder 14 is provided with a plurality of axially extending plateaus 51 angularly spaced about the circumference of the second member 13 and in alignment with the axial grooves 12. The plateaus 51 serve to reduce the cross-sectional area of the passageways. It has been determined empirically that for a hair treatment solution having a predetermined viscosity the passageways will have an optimum cross-sectional area such that the hair treatment solution directed to the passageways from diverting chamber 18 under the normal pressure of a squeeze bottle will be urged along the full length of the passageways before any appreciable amount of solution is absorbed by the strands of hair coiled around the outer wall 11. Thus, by adjusting the cross-sectional area of the passageways, a uniform saturation of the hair can be achieved. Those skilled in the art will readily be able to determine the optimal passageway area for any given solution.

The embodiment of FIG. 4 also includes a plurality of protrusions 52 at the end of the second member 13 which is opposite the closed end 21. The protrusions 52 are angularly spaced about the circumference of the second member 13 and register with the axial grooves 12. The protrusions 52 are formed to block the passageways when the member 13 is inserted within the member 10. Blocking the ends of the passageways in this manner prevents excess solution from dripping out of the passageways at the ends. At the opposite end of the rod the axial grooves 12 are closed a short distance before reaching end-defining means 17 and closed end 21 as indicated at 53 in FIG. 4.

To form a single S curve in a length of hair, the hair must be wrapped approximately two and one-half times around a roller. Thus, a one-inch diameter roller is needed to impart an S wave to an eight-inch length of hair and a one and one-half inch diameter roller is needed for a twelve-inch length of hair. In the past such large rollers have not been available because it has been beyond the patience and skill of the ordinary practitioner to properly saturate hair wrapped on such rollers without getting hair treatment solution on the patron's scalp. For the first time the present invention enables a cosmetologist of ordinary skill to fashion long, naturally straight hair with a gentle body wave.

For the first time the invention also enables a do-it-yourself hair stylist having no special cosmetologist training to give high-fashion long hair permanents in the home. The invention serves to enhance the quality of a home permanent because it makes application of the proper amount of hair treatment solution easy.

Figure 3:
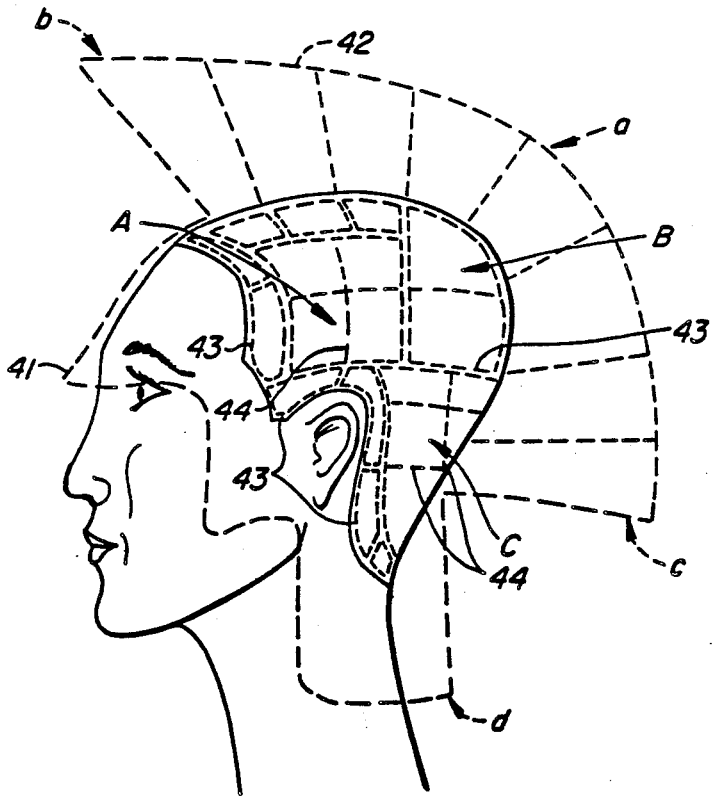
FIG. 3 shows a coded perm pattern for use with a correspondingly coded assembly of the hair-waving implements disclosed herein, so as to provide a do-it-yourself kit enabling the user with no special training to give a fashionable body wave to long hair in the home.

To assist the do-it-yourself hair stylist in recreating the popular looks of the day, the present invention provides a kit including a perm pattern for trimming and wrapping the hair and an assembly of hair-waving implements which are coded to correspond to the perm pattern. A simplified such pattern is shown in FIG. 3. Shown in phantom in FIG. 3 is an outline 41 showing the lengths to which the hair is to be trimmed around the hair line and an outline 42 showing the hair lengths down the center of the head from the forehead to the nape of the neck. At various reference points the pattern indicates the length, denoted here by the letters a, b, c, and d, to which the hair is to be trimmed. The perm pattern of FIG. 3 also displays a pattern of sectioning lines 43 and sub-sectioning lines 44. Strands of hair in each section or block outlined by the sectioning lines 43 are wrapped around rollers of a predetermined size. When a section is further sub-sectioned by the sub-sectioning lines 44, the strands of hair within each sub-section are wrapped around a single roller, the same size roller being used for all sub-sections within a section. Perm patterns of the sort are well known to professional hair stylists, who without any further instruction will generally understand the proper size and number of rollers to use. In the kit provided here, however, the perm pattern and the rollers are coded so that the proper sized roller will be matched to the proper section. For example, they may be color coded or they may carry indicia as the letters A, B and C in the perm pattern of FIG. 3 and on the end cap 31 of the roller shown in FIG. 1A.

When a patron has received a fashionable and expensive perm from a professioal hairstylist, the present kit enables the home stylist to revitalize the perm once it begins to grow out and sag. The hair is first trimmed and shaped to correspond to the pattern provided in the kit, and then the hair is sectioned off and wrapped on the appropriately coded rollers. With the roller design of the present invention, much less skill is needed to apply the appropriate amount of hair treatment solution, thereby making it far more suitable for home use.

In summary, the inventive concept disclosed herein may be embodied in various different constructions. All such constructions, however, will provide an elongate rod member around which the strands of hair are wrapped, means defining a plurality of slender axially extending passageways within the rod member, and means defining a diverting chamber at an end of the rod member in flow communication with the plurality of passageways. Each of the passageways is in flow communication along its length with the exterior of the rod member, so that hair treatment solution squirted into the diverting chamber will be forced through the passageways and to the hair wrapped around the rod member.

While the above provides a full and complete disclosure of the preferred embodiments of the invention, various modifications, alternate constructions, and equivalents maybe employed without departing from the true spirit and scope of the invention. Therefore, the above description and illustration should not be construed as limiting the scope of the invention, which is defined by the appended claims.

What is claimed is:

1. A hair waving rod for use in giving a body wave to hair comprising:

a first member providing an outer wall having a generally cylindrical shape for wrapping strands of hair therearound;

a second member providing an inner wall, said second member having a closed end and being positionable within said first member;

partitioning means between said inner and outer walls defining a plurality of slender axial passageways uniformly angularly spaced about the region between said walls, said plurality including at least four passageways;

a plurality of axial grooves in said outer wall, each groove permitting flow of fluid from one of said passageways;

means defining a closed end of said first member, said end-defining means having an inlet aperture;

means within the region between said enddefining means and the closed end of said second member for directing flow of fluid from said inlet aperture to said plurality of passageways, whereby hair treatment solution introduced under pressure into said inlet aperture will be uniformly distributed among said passageways and dispensed through said grooves to strands of hair coiled around said outer wall;

said second member and said partitioning means being formed to provide said passageways with a cross-sectional area sufficiently small that hair treatment solution directed to said passageways under pressure from said inlet aperture will flow the entire length of said passageways before being absorbed by said strands of hair; and attachment means at opposite ends of said hair waving rod for securing thereto a means for retaining the hair in its wrapped configuration.

2. The hair waving rod of claim 1 wherein said second member includes means at the end thereof opposite said closed end registering with said axial grooves and formed to block said passageways.

3. A rod for use in giving a permanent wave to hair comprising:

a hollow outer cylinder having a plurality of axial grooves spaced about its circumference;

an inner cylinder adapted to be inserted within said outer cylinder, said inner cylinder being closed at a first end thereof and having a plurality of angularly spaced protrusions at the opposite end thereof, the portions of said outer cylinder which extend between adjacent grooves being formed along their inner surface to contact said inner cylinder along its length so as to define a plurality of axial passageways, said protrusions registering with said axial grooves and being formed to block said passageways at one end when said inner cylinder is inserted within said outer cylinder, and said inner cylinder having a plurality of axially extending plateaus angularly spaced about the circumference thereof in alignment with said axial grooves for reducing the cross-sectional area of said passageways;

means at an end of said outer cylinder providing a wall with a centrally located inlet aperture, said wall and the closed end of said inner cylinder defining a chamber communicating with said passageways and said wall being formed to provide baffles within said chamber for directing flow of hair treatment solution introduced at said inlet aperture to said passageways; and a cap formed to secure said inner cylinder within said outer cylinder and to secure said protrusions in their passageway-blocking configuration.

* * * * *